United States Patent [19]

Tinkler

[11] Patent Number: 4,662,781

[45] Date of Patent: May 5, 1987

[54] APPARATUS FOR CREATING WATER SPORTS RAMP

[76] Inventor: Michael R. Tinkler, 545 Ulumalu Rd., Haiku, Maui, Hi. 96708

[21] Appl. No.: 588,787

[22] Filed: Mar. 12, 1984

Related U.S. Application Data

[63] Continuation-in-part of Ser. No. 523,163, Aug. 15, 1983, abandoned.

[51] Int. Cl.[4] ..... E02B 3/00

[52] U.S. Cl. ..... 405/79; 405/52

[58] Field of Search ..... 405/52, 22, 79, 61; 4/491, 492

[56] References Cited

U.S. PATENT DOCUMENTS

| | | | |
|---|---|---|---|
| 1,716,616 | 6/1929 | Brasher | 405/22 |
| 3,068,655 | 12/1962 | Murray et al. | 405/22 |
| 3,103,788 | 9/1963 | Gross | 405/22 |
| 3,221,503 | 12/1965 | Wikson | 405/22 |
| 3,452,966 | 7/1969 | Smolski | 405/52 X |
| 3,477,233 | 11/1969 | Andersen | 405/79 |
| 3,611,727 | 10/1971 | Blandford | 405/79 |
| 3,683,627 | 8/1972 | Girden | 405/52 |
| 3,789,612 | 2/1974 | Richard et al. | 405/79 |
| 4,062,192 | 12/1977 | Biewer | 405/79 |
| 4,375,337 | 3/1983 | Yeger | 4/491 |

FOREIGN PATENT DOCUMENTS

| | | | |
|---|---|---|---|
| 433439 | 4/1948 | Italy | 405/79 |
| 41392 | 3/1977 | Japan | 405/79 |

*Primary Examiner*—Dennis L. Taylor

*Attorney, Agent, or Firm*—Ralph S. Branscomb

[57] ABSTRACT

Apparatus is provided for creating the ramp or "jump" in the water, much like a ski jump, but being constructed such that a rather thick layer beneath the top surface is non-integral to permit the fin of the windsurfer to pass therethrough. The maintenance of this non-integral layer may be created in several ways, the simplest being the utilization of a water jet or jets somewhat beneath the water level which create a continuous mound or ramp of water. Other approaches utilize a thick layer of bristles saturated with water, and a layer of gel.

17 Claims, 13 Drawing Figures

FIG 1
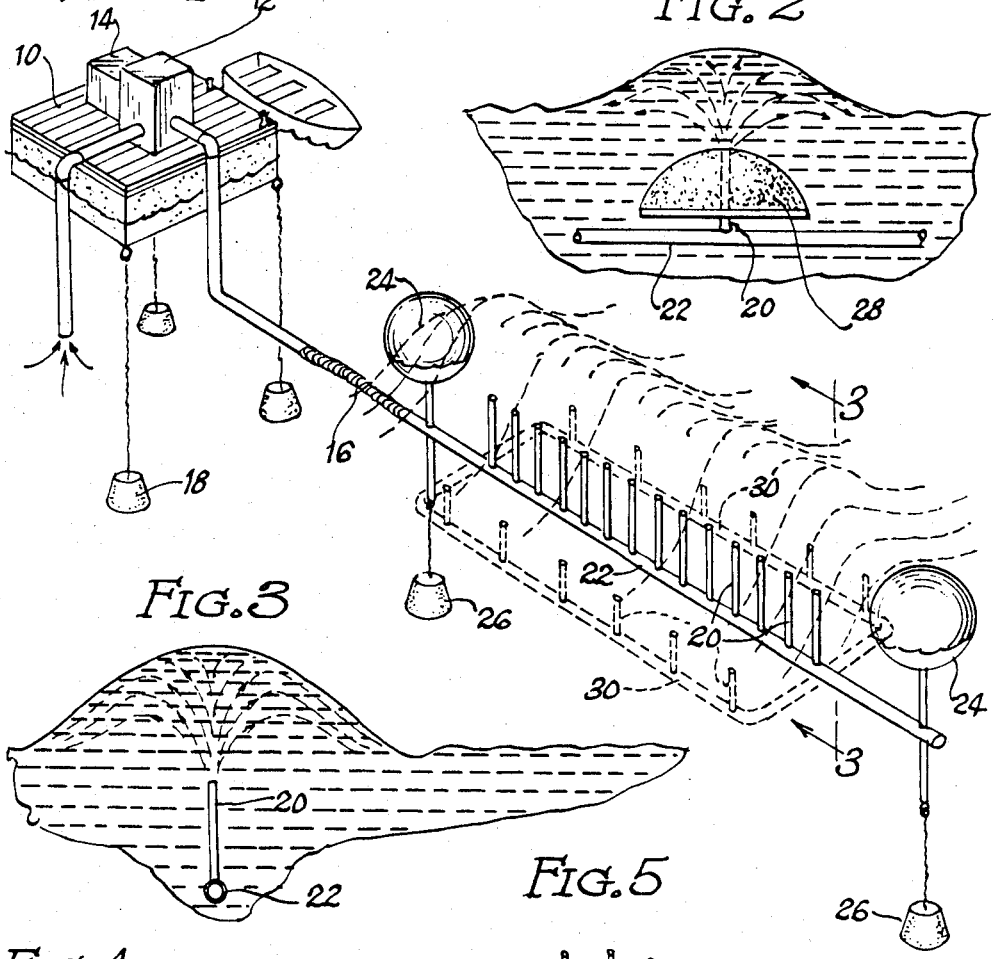
FIG. 2
FIG. 3
FIG. 4
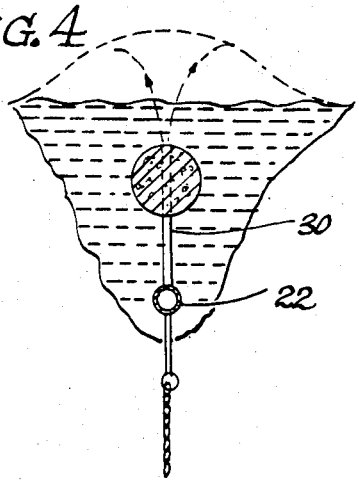
FIG. 5
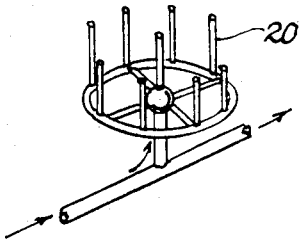
FIG. 6
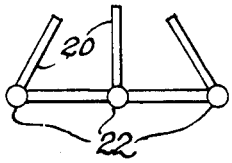
FIG. 7
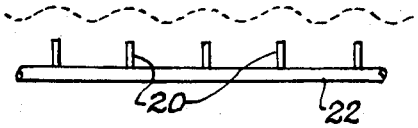

FIG. 8
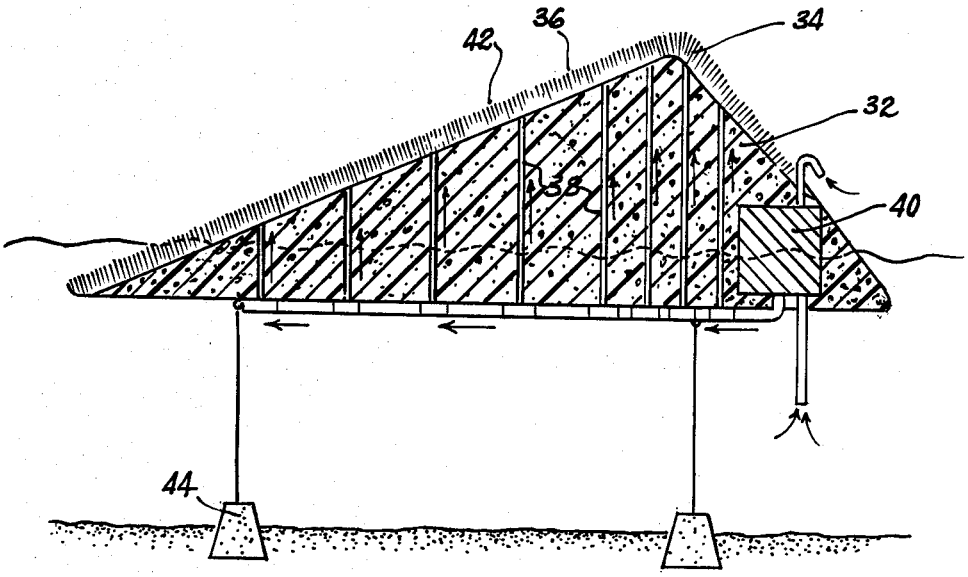
FIG. 9
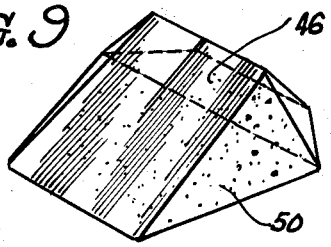
FIG. 10
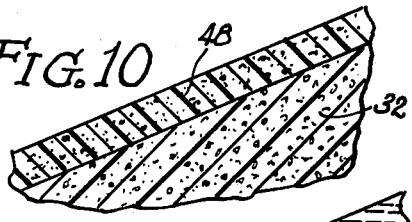
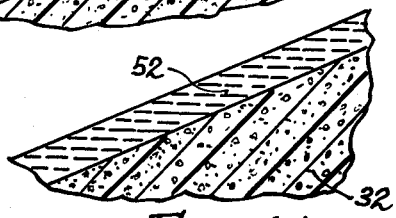
FIG. 11
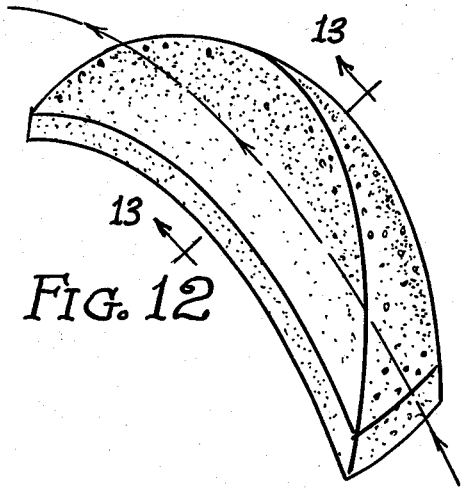
FIG. 12
FIG. 13
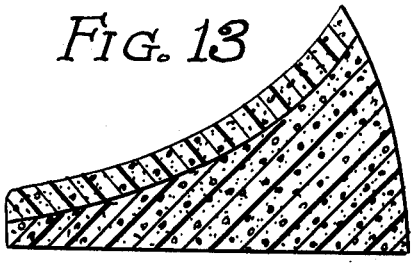

APPARATUS FOR CREATING WATER SPORTS RAMP

BACKGROUND OF THE INVENTION

This application is a continuation-part of an application having Ser. No. 06/523,163, filed 08/15/83 now abandoned.

The sport of surfing is now decades old, reaching a high plateau of popularity probably in the late 1950's and early 1960's. In those times and to a large extent consistently until the present, part of the national attention has been focused on the romantic, carefree living that is perceived to exist in California, and which has been most exemplified, at least to young people, by the sport of surfing. Although people living inland have the advantage of movies, magazines, and the Beach Boys, nevertheless, the great masses of people not having access to the generally large waves produced by the Pacific Ocean could not experience the thrill of surfing. To enable inland people to enjoy surfing on their waveless lakes, the sailboard was developed about twenty years ago.

The first sailboard, or windsurfer, was only invented a couple of decades ago but already the popularity of the sport, especially in Europe, is staggering. There are many sailboard manufacturers, there are magazines directed specifically toward the sport, and there are competition events all over the world.

One of the more spectacular uses of the sailboard is the jump off of an ocean wave. As memorialized in the magazines dealing with the sport, an expert sailboarder can fly off waves and achieve elevations of up to six or eight feet, achieving a feeling of exhiliration that is surely wonderful. In fact, still photos in a magazine provide one of the few opportunities to show the speed and the thrill that sailboards produce.

Unfortunately, most people do not live within driving range of an ocean that produces large, jumpable waves. Whereas the sailboard enables inlanders to experience to some extent the feeling of surfing without having waves, nevertheless, the thrill of actually jumping the waves is absent. To enable these inlanders to enjoy the thrill of wave jumping, there is a need for some type of apparatus that will produce a water ramp, similar to a ski ramp but made of water rather than wood, that the sailboarders can sail into and over.

SUMMARY OF THE INVENTION

The invention fulfills the above-stated need by providing a ramp surface which has a non-integral top layer deep enough to permit the fin of the windsurfer to pass through it, with this layer also having sufficient mass to act like water. This layer is created in several alternative ways. First, it is done with the creation of a powerful upcurrent, preferably just beneath the water's surface, which causes a mound or ramp of water to stand over the water surface for jumping by sailboarders and the like. Water jets positioned at or below the water surface, in various configurations, produce either an elongated ramp as a result of a line of jets, or one or more mounds which can be approached from any angle. In the preferred embodiments, the jets are held in place by floats and anchors so that they may be moved from lake to lake. In use, the floats hold the jets at just the right elevation which, of course, is important to their proper functioning.

In another embodiment, the non-integral layer is provided by means of a mat of deep bristles, with water being pumped into the bristle layer at the top, and preferably at different levels down the slope as well. The bristles tend to retard the flow of water downhill, and enable a smaller pump to be used than would be required for the water mound. While adequately maintaining an adequate mass of water in the bristle layer to support a moving sailboard.

In yet another embodiment, a gel is used, either alone or in conjunction with retaining bristles, to hold water in suspension. If a thin gel is used, it slides slowly down the ramp without the support of bristles or other structure and therefore would be used in conjunction with a pump similar to the embodiment mentioned above to continually re-deliver the gel to the upper reaches of the ramp.

In the optimal implementation of the invention a platform floating adjacent to the jets mounts the pump and the pump engine, and may also provide a teaching platform whereby an instructor can coach his jumpers. This is a very important aspect of the invention, inasmuch as the amount of instruction that one can receive in the ocean, and particularly when jumping ocean waves, is naturally rather limited by the environmental circumstances.

Along the same line, although wave jumping competition is very popular, judging the contestants is by no means scientific. Compared to a broad jump on land, where the exact location the heels land can be easily determined, the length of a jump on an ocean wave, again by dint of the environment, is impossible to gauge accurately. The same is true with the height. Thus, competitive events in which height and/or distance are important cannot be accurately judged in the ocean. But they can be accurately judged on the fresh water ramp of the instant invention.

Also, by controlling the jump, the ramp can be brought near the coastline of a lake, running orthogonally to the shore so that the onlookers can get a side view of the jump, which is much more revealing than the front view. Onlookers at a beach can only get close-ups of the front view because the wave runs parallel to the shore.

Yet another advantage of having a controlled jump rather than an ocean wave lies in safety to both the sailboarder and his sailboard. In ocean waves, if the sailboarder does not land on his feet after a jump, but is instead in the water with his sail floating on the surface, the next wave could prove to be disastrous to the rider and even worse to his equipment. If he can't get out of the wave before it crashes, there is almost certain to be some destruction and/or bodily injury.

The controlled, single ramp naturally eliminates this problem inasmuch as there is no wave to crash on the rider whether or not he lands on his feet. In addition to saving equipment, this enables jumpers to learn how to jump waves in a safe environment so that when they do go out into the ocean they won't risk body and equipment while progressing up the learning curve.

BRIEF DESCRIPTION OF THE DRAWINGS

FIG. 1 is a perspective view of the one embodiment;

FIG. 2 is a side elevation view illustrating a jet with a foam float and deflector;

FIG. 3 is a section taken along line 3—3 of FIG. 1 illustrating the shape of the water ramp;

FIG. 4 illustrates yet another form of jet;

FIG. 5 is a perspective view illustrating a circular arrangement of jets to produce a single mound;

FIG. 6 is a diagrammatic view illustrating converging jets;

FIG. 7 illustrates a mound pattern formed by having spaced jets on a single manifold;

FIG. 8 is a section illustrating the embodiment of the ramp in which bristles are used;

FIG. 9 is an isometric view illustrating an embodiment having a series of slits, and illustrating the overall shape of the ramp of the type shown in FIG. 8;

FIG. 10 is a section taken through the surface of the ramp in FIG. 9 illustrating the Foam or sponge which defines the slits;

FIG. 11 is a section through a ramp similar to FIG. 9 but having a gel layer rather than bristles or foam;

FIG. 12 illustrates a differently shaped ramp used for making rebounds rather than over-the-ramp jumps;

FIG. 13 is a section taken along line 13—13 of FIG. 12 to illustrate the shape of the ramp.

DETAILED DESCRIPTION OF THE PREFERRED EMBODIMENT

Although it would, of course, be possible to have a fixed ramp system which is more or less mounted in a lake for the season, in all of the preferred embodiments, everything is removable so that the system can be taken from lake to lake. This also, of course, expedites maintenance of the system.

In the first embodiment shown in FIG. 1 a raft 10 floats to pump 12 and the motor 14 which drives the pump and communicates to the main part of the ramp through a flexible connector 16. The raft or floating platform ideally would be large enough and of sufficient buoyancy to support at least one person, such as the instructor for one or more sailboard students. The raft is anchored by suitable tethered anchors 18 which do not have to be too elaborate inasmuch a there would not be strong currents in inland waterways, unless it is used on a river.

In the embodiment shown in FIG. 1, the jets 20 are arranged along a single straight manifold 22. The manifold takes the form of a rigid pipe and is supported at each end by floats 24 tethered to anchors 26. The jets 20 are at least semi-rigid and thus require protection so that a sailboarder or his equipment does not come crashing down onto a rigid pipe and get injured. The jets could either be somewhat flexible, or they could be covered by a fairing 28 as shown in FIG. 2. If the jets are as close together as shown in FIG. 1, the fairing can be continuous, covering all of the jets. The fairing could also be made of rigid foam, such as the material the sailboards themselves are made of, so that the fairing also doubles as flotation means.

FIG. 3 illustrates the approximate wave shape that it would be desired to produce in the arrangement shown in FIG. 1. This could be augmented by the addition of one or more additional manifolds 30 with their jets 20 as shown in dotted line in FIG. 1. This would produce a higher ramp, and one having a different configuration. The central row of jets could be the same as the additional manifolds, or it could provide a greater water flow by virtue of being larger in diameter or closer to the water's surface. This would be in keeping with the desire to have the central portion of the ramp as high as possible, sloping down in most directions laterally.

FIG. 4 illustrates yet another modification wherein the top of a special jet 30 is mounted in a spherical foam mass for the same purpose fairing 28. That is, it doubles as protection for the windsurfer, and is a float to hold the jet in the upright position. Jets of this type can be positioned in any fashion desirable, such as being several in number on a flexible, free-floating octopus supply line, or being rigid. A rigid arrangement shown in FIG. 7, produced by having the jets spaced sufficiently apart as the area between the jets is more or less at the normal surface height of the body of water, provides different challenges to the sailboarder than the embodiment shown in FIG. 1. The arrangement of FIG. 7 would allow the sailboarder to divert his course between the mounds at the last minute if he lost nerve. The mound shape provided by the single jet would also yield somewhat more flexibility in approach and trajectory for the sailboarder.

FIG. 5 illustrates a generally circular configuration wherein a mound is created with additional jets, similar to the addition of the line of jets shown in phantom in FIG. 1. Undoubtedly, experimentation with different arrangements of jets to provide different surface configurations of the water mound will yield different thrills and offer different challenges to sailboarders.

FIG. 6 illustrates the possibility of angling the jets slightly toward one another to produce a more concentrated upflow of water. This could be done in a configuration such as shown in FIG. 1, or in a mound configuration such as illustrated in FIG. 5. The possibilities are vast.

A number of options and modifications of the water jet embodiments as shown come to mind. As indicated above, the pumping system could be land-based as well as built on a raft. Different configurations of jets for producing different shapes that will yield a variety of different effects when the windsurfer banks. Other means of securing the system in place besides the anchor shown, such as tethers, would be possible.

Turning now to the embodiment in FIG. 8, the same concept of the floating ramp is used by the provision of an open-celled foam wedge 32. By being open-celled, the ramp 6 somewhat in the water as shown in FIG. 8 rather than being right at the surface. An example of a suitable material is two-pound open cell Urethane TM-foam.

The foam supports the top layer 34, which in this embodiment consists of a multiplicity of closely spaced, long bristles 36. In the preferred embodiment bristles these would be coated with teflon TM), or other low friction surface, to pass the fin and board across the bristle layer with minimum drag.

A piping system 38 delivers water, pumped up from the water body by pump 40, to the upper levels of the incline as well as to levels spaced along the surface. The planar surface of the foam 32 and the latteral foam siderails 41 prevent the water from escaping other than running down the surface, and the bristles 36 so impede the water that the water level is maintained substantially at the surface 42 defined by the bristles. Naturally, the strength of the pump 40, the water flow, and the density of the bristles 36 must be balanced to achieve this effect. Ballast 44 can be used to maintain the proper position and orientation of the ramp.

FIG. 9 is a slight modification in which the ramp utilizes, rather than bristles, a series of slits 46 cut in a sponge-like material 48 shown in FIG. 10. The ramp also has tapered sides 50 to stabilize the unit in high winds. Although the slits are possible as shown in FIG. 9 for straight jumps, they are very limited, as a diagonnal jump would not be possible, and the board would have to be maintained very straight by the rider to enable the fin to properly slide in the slits. If the momentum of the wind surfer were such that substantial side slippage were necessary, an accident might occur.

And yet another embodiment shown in FIG. 11, a layer of gel 52 is used for the non-integral layer. A stiff gel will remain on the platform with a minimum of support without slipping, but provides resistance to the fin and bottom surface of the windsurfer hull. A less rigid gel can be used, but requires at least some bristles to hold it in place, although not the same density of bristle required for the embodiment shown in FIG. 8. Without the bristles it would slide downhill, requiring the use of a pump such as pump 40 to return it to the top. A gel collecting system at the bottom of the ramp collects the gel as it slides to the bottom and delivers it to the pump.

Turning now to FIG. 12, this embodiment is not limited to any particular embodiment of the non-integral layer, except that the slits 46 would not work well. The embodiment shown in FIG. 12 is used for rebound type action rather than flying over the top of the ramp. The action would be somewhat similar to the action of a skateboard on the curved complex plane of the inside of a swimming pool or skateboard run.

In addition to use by sailboarders, which is the primary thrust of the invention, it would be also useable by other water sportsters such as jet ski riders, and even skiers, who would might like the somewhat different effect achieved from jumping from a water ramp rather than a rigid wooden version. The possibilities are virtually limitless.

While the preferred embodiment of the invention has been described, other modifications may be made thereto and other embodiments may be devised within the spirit of the invention and the scope of the appended claims.

I claim:

1. An apparatus for creating a raised area in a body of water for recreational use by the windsurfers, said apparatus comprising:

(a) a water pump with at least one upwardly directed jet;

(b) flotation means for said pump and said at least one jet with said at least one jet being suspended at a predetermined depth beneath the surface of the water;

(c) anchor means tethered to said flotation means to hold same stationary against lateral translation and said jets being mounted on an elongated first manifold and said flotation means comprise a pair of floats connected to each end of said manifold to support same at a particular height to define a wide water ramp for use in jumping water sports.

2. Structure according to claim 1 wherein said jets are mutually spaced sufficiently to produce a linear row of substantially separated water mounds.

3. Structure according to claim 1 wherein said jets are sufficiently close to one another to define a substantially continuous water ramp.

4. The structure according to claim 3 and including at least one additional manifold running parallel to said first manifold and having a plurality of upwardly directed jets.

5. Structure according to claim 4 wherein said additional manifolds are two in number and disposed on opposite sides of said first manifold.

6. Structure according to claim 1 wherein said jet is covered with a protective fairing for the safety of water sports participants and said fairing comprises foam and doubles as flotation means.

7. Structure according to claim 1 and including a plurality of jets arranged in a generally radially symmetrical pattern to produce a mound of water.

8. Structure according to claim 1 and including a plurality of upwardly directed jets at least some of which converge toward the top to produce convergent water currents.

9. Structure according to claim 1 wherein said flotation means comprises a mass of open-celled foam such that same absorbs water and floats partially submerged.

10. An apparatus for creating a raised area in a body of water for recreational use by windsurfers, said apparatus comprising:

(a) a frame including an inclined planar member extending from below the surface of said body of water to well above same;

(b) a layer of generally outwardly projecting bristles substantially covering said planar member, the tips of which substantially define a surface spaced from same planar member;

(c) a water pumping system for maintaining said bristles saturated with water; and, (d) said water pumping system introducing water at the top of said inclined planar member and said bristles being sufficiently closely spaced to maintain the water level therein substantially at the top of said bristles under the action of the pumping system.

11. Structure according to claim 10 wherein said water pumping system includes a piping system that introduces water at spaced levels along said layer.

12. Structure according to claim 10 wherein said planar member is flat.

13. Structure according to claim 10 wherein said planar member is curved to define a re-bound type ramp.

14. Structure according to claim 10 wherein said bristles are coated with a low friction surface.

15. Structure according to claim 13 and including a gel which is maintained in place at least in part by said bristles.

16. Structure according to claim 13 and including a gel incorporated in the water pumped by said pumping system such that said gel is pumped to the top of said inclined layer.

17. An apparatus for creating a raised area in a body of water for recreational use by the windsurfers, said apparatus comprising:

(a) a frame including an inclined planar member extending from below the surface of said body of water to well above same;

(b) a layer covering said planar member and defining a surface that is substantially parallel with said planar member;

(c) a water pumping system for pumping water onto said layer; and, (d) said layer comprising a soft, porous material having a multiplicity of parallel slits therein sufficiently deep to pass the fin of a windsurfer.

* * * * *